US008552342B2

(12) United States Patent
Sakakibara

(10) Patent No.: US 8,552,342 B2
(45) Date of Patent: Oct. 8, 2013

(54) HEATER AND IMAGE HEATING APPARATUS INCLUDING THE SAME

(75) Inventor: Hiroyuki Sakakibara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 373 days.

(21) Appl. No.: 12/876,551

(22) Filed: Sep. 7, 2010

(65) Prior Publication Data

US 2011/0062140 A1 Mar. 17, 2011

(30) Foreign Application Priority Data

Sep. 11, 2009 (WO) ..... PCT/JP2009/065903

(51) Int. Cl.

| | |
|---|---|
| ***G03G 15/20*** | (2006.01) |
| ***H05B 3/10*** | (2006.01) |
| ***H05B 3/16*** | (2006.01) |
| ***H05B 3/20*** | (2006.01) |
| ***H05B 3/24*** | (2006.01) |

(52) U.S. Cl.

USPC ..... 219/216; 219/539; 219/541; 219/552; 399/329

(58) Field of Classification Search

None

See application file for complete search history.

(56) References Cited

U.S. PATENT DOCUMENTS

| | | | | |
|---|---|---|---|---|
| 4,814,586 | A | 3/1989 | Grise | |
| 5,640,231 | A * | 6/1997 | Mitsui et al. | 399/335 |
| 6,096,995 | A * | 8/2000 | Toyota et al. | 219/216 |
| 6,456,819 | B1 * | 9/2002 | Abe et al. | 399/329 |
| 2012/0121306 | A1 * | 5/2012 | Shimura et al. | 399/329 |
| 2012/0201581 | A1 * | 8/2012 | Shimura | 399/329 |
| 2012/0201582 | A1 * | 8/2012 | Shimura et al. | 399/329 |

FOREIGN PATENT DOCUMENTS

| | | | |
|---|---|---|---|
| JP | 57-501308 | T | 7/1982 |
| JP | 11-282302 | A | 10/1999 |
| JP | 2005-209493 | A | 8/2005 |
| JP | 2006-120600 | A | 5/2006 |
| JP | 2007-025474 | A | 2/2007 |

OTHER PUBLICATIONS

JP2005-209493A, Aug. 2005, Nakahara, partial translation.*
JP2007-025474A, Feb. 2007, Taniguchi, partial translation.*

* cited by examiner

*Primary Examiner* — Joseph M Pelham
(74) *Attorney, Agent, or Firm* — Canon U.S.A., Inc. IP Division

(57) ABSTRACT

To provide a heater that can reduce fixing failure in a paper passing area while suppressing a temperature rise in a sheet non-passing area, and a fixing apparatus including the heater. Resistors are connected in parallel between two conductive patterns that are provided on a heater substrate along the longitudinal direction of the substrate, and resistors are arranged so that the shortest current path of each of the resistors can overlap the shortest current path of an adjacent resistor in the longitudinal direction of the substrate.

12 Claims, 12 Drawing Sheets

HEATER AND IMAGE HEATING APPARATUS INCLUDING THE SAME

TECHNICAL FIELD

The present invention relates to a heater suitable for use in a heating/fixing apparatus mounted in an image forming apparatus, and to an image heating apparatus including the heater.

BACKGROUND ART

Fixing apparatuses mounted in copying machines or printers include an apparatus having an endless belt, a ceramic heater that comes in contact with the inner surface of the endless belt, and a pressure roller that forms a fixing nip portion with the ceramic heater with the endless belt therebetween. When an image forming apparatus including such a fixing apparatus performs continuous printing using small-sized sheets, a phenomenon (temperature rise in a sheet non-passing area) occurs in which the temperature of a region through which the sheets do not pass in the longitudinal direction of the fixing nip portion gently increases. If the temperature of the sheet non-passing area becomes too high, individual parts in the apparatus may be damaged, or if printing is performed using a large-sized sheet during a temperature rise in the sheet non-passing area, high-temperature offset of toner may occur in an area corresponding to the sheet non-passing area of small-sized sheets.

One of conceived techniques for suppressing a temperature rise in the sheet non-passing area is that a heat generating resistor on a ceramic substrate is formed of a material having a negative resistance temperature characteristic. The concept is that even if the temperature of the sheet non-passing area rises, the resistance value of a heat generating resistor in the sheet non-passing area decreases and therefore heat generation in the sheet non-passing area can be suppressed even if a current flows in the heat generating resistor in the sheet non-passing area. The negative resistance temperature characteristic is a characteristic in which as temperature increases, resistance decreases, and is hereinafter referred to as NTC (Negative Temperature Coefficient). Conversely, it is also conceived that the heat generating resistor is formed of a material having a positive resistance temperature characteristic. The concept is that if the temperature of the sheet non-passing area rises, the resistance value of the heat generating resistor in the sheet non-passing area rises and the current flowing in the heat generating resistor in the sheet non-passing area is suppressed so that heat generation in the sheet non-passing area can be suppressed. The positive resistance temperature characteristic is a characteristic in which as temperature increases, resistance increases, and is hereinafter referred to as PTC (Positive Temperature Coefficient).

In general, however, materials with NTC have a very high volume resistivity, and it is very difficult to set the total resistance of a heat generating resistor formed in a single heater within a range covered by a commercial power supply. Conversely, materials with PTC have a very low volume resistivity, and, as in the case of those with NTC, it is very difficult to set the total resistance of a heat generating resistor in a single heater within a range covered by a commercial power supply.

Therefore, a heat generating resistor formed on a ceramic substrate is divided into a plurality of blocks in the longitudinal direction of a heater, and in each block, two electrodes are arranged at the ends of the substrate in the lateral direction so that a current can flow in the lateral direction of the heater (the direction in which recording paper is conveyed). Further, a configuration in which a plurality of blocks are electrically connected in series is disclosed in PTL 1. With the above shape, if the heat generating resistor is made of a material with NTC, the resistance value of each block is low, and the total resistance of the overall heater can be kept lower than that if a current flows in the longitudinal direction of the heater. Further, when the heat generating resistor is made of a material with PTC, the total resistance of the overall heater can be made higher than that if a current flows in the lateral direction of the heater without dividing the heat generating resistor into a plurality of blocks.

Note that if a heat generating resistor is divided into a plurality of heat generating blocks, there is a space between adjacent heat generating blocks, leading to variations in the heat generation distribution. Thus, in PTL 1, heat generating blocks are formed into a parallelogram shape so as to prevent formation of a region where heat is not generated in the longitudinal direction of the heater.

CITATION LIST

Patent Literature

PTL 1 Japanese Patent Laid-Open No. 2007-025474

However, it has been found in later studies that the shape of the heat generating blocks disclosed in PTL 1 does not provide a sufficient effect of suppressing a variation in the heat generation distribution. FIG. 12 illustrates a portion of this heater. 22*a* denotes an elongated substrate, and a conductive pattern 29*q* (29*q*1, 29*q*2, . . . ) and a conductive pattern 29*r* (29*r*1, 29*r*2, . . . ) are disposed on the substrate along the longitudinal direction of the substrate. Both the conductive patterns 29*q* and 29*r* are separated at a plurality of portions in the longitudinal direction of the substrate. Heat generating resistors 29*b* (29*b*1, 29*b*2, . . . ) are connected between the conductive patterns 29*q* and 29*r*. 22*e*1 denotes an electrode to which a feed connector is connected (an electrode at the other end is not illustrated in the figure).

As illustrated in FIG. 12, even if heat generating blocks are formed into a parallelogram shape so that an arbitrary point on recording paper can always pass through a region where a heat generating resistor 29*b* exists, a large amount of current does not flow in regions B where heat generating resistors overlap in the longitudinal direction of the heater. This is because, as illustrated in FIG. 12, shortest current paths are located in regions other than the regions B where overlapping occurs and the majority of the current flows in the shortest current paths. Since the amount of heat generated is proportional to the square of the current, the amount of heat generated in a region where a small amount of current flows decreases, thus reducing the effect of suppressing a variation in the heat generation distribution in the longitudinal direction of the heater. Large variations in the heat generation distribution in this manner causes variations in heat on the image. Further, if one heat generating block has both a region where a current easily flows and a region where a current does not easily flow, as in the above description, the problem of variations in the heat generation distribution occurs.

SUMMARY OF INVENTION

The present invention provides a heater including a substrate, a first conductor provided on the substrate along a longitudinal direction, a second conductor provided on the substrate along the longitudinal direction at a position different from that of the first conductor in a substrate lateral direction, and a resistor connected between the first conductor and the second conductor, wherein a plurality of resistors are connected in parallel between the first conductor and the second conductor, and a shortest current path of each resistor overlaps a shortest current path of an adjacent resistor in the longitudinal direction.

Further, the present invention provides a heater including a substrate, a first conductor provided on the substrate along a longitudinal direction, a second conductor provided on the substrate along the longitudinal direction at a position different from that of the first conductor in a substrate lateral direction, and a resistor connected between the first conductor and the second conductor, wherein a plurality of rows of blocks each having a plurality of resistors connected in parallel between the first conductor and the second conductor are provided at different positions in the lateral direction of the substrate, and a shortest current path of each resistor in one of the rows of blocks in the lateral direction overlaps a shortest current path of each resistor in another row of blocks in the longitudinal direction.

Further features of the present invention will become apparent from the following description of exemplary embodiments with reference to the attached drawings.

DESCRIPTION OF EMBODIMENTS

Figure 1:
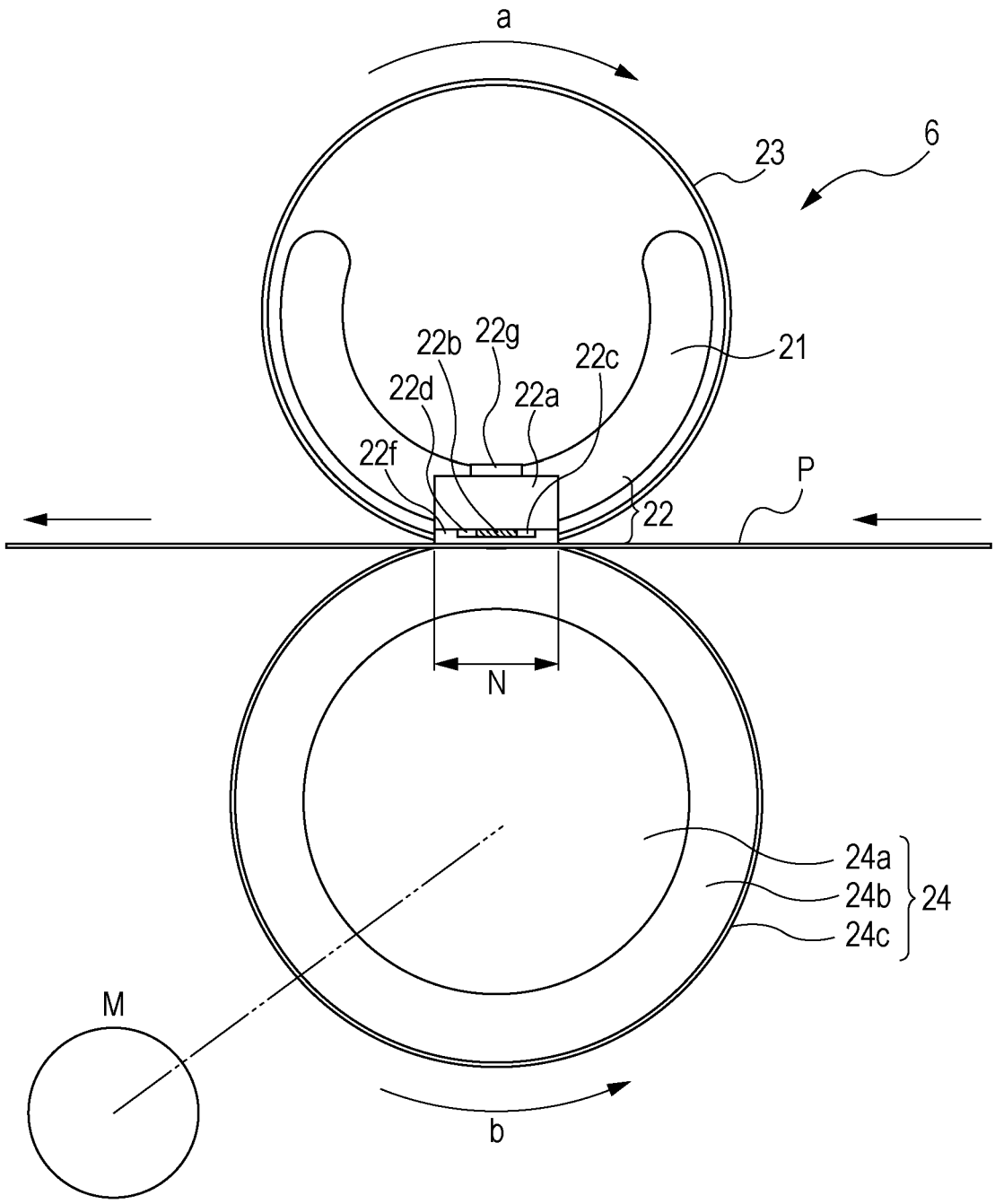
FIG. 1 is a cross-sectional view of an image heating apparatus.

FIG. 1 is a cross-sectional view of a fixing apparatus 6 serving as an image heating apparatus. The fixing apparatus 6 includes a cylindrical film (endless belt) 23, a heater 22 that comes in contact with the inner surface of the film 23, and a pressure roller (nip portion forming member) 24 that forms a fixing nip portion N together with the heater 22 with the film 23 therebetween. The material of the base layer of the film is heat-resistant resin such as polyimide, or metal such as stainless steel. The pressure roller 24 includes a core metal 24*a* of a material such as iron or aluminum, an elastic layer 24*b* of a material such as silicone rubber, and a mold release layer 24*c* of a material such as PFA. The heater 22 is held by a holding member 21 composed of heat-resistant resin. The holding member 21 also has a guide function for guiding the rotation of the film 23. The pressure roller 24 rotates in the direction of an arrow b in response to a driving force from a motor M. In accordance with the rotation of the pressure roller 24, the film 23 also rotates.

The heater 22 includes a ceramic heater substrate 22*a*, a heat generating resistor 22*b* formed on the substrate 22*a*, conductive patterns (conductors) 22*c* and 22*d*, and an insulating (in the exemplary embodiment, glass) surface protection layer 22*f* that covers the heat generating resistor 22*b* and the conductive patterns 22*c* and 22*d*. A temperature sensing element 22*g* such as a thermistor is provided in contact with the back surface side of the heater substrate 22*a*. The power supplied from a commercial alternating-current power supply to the heat generating resistor 22*b* is controlled in accordance with the temperature sensed by the temperature sensing element 22*g*. A recording material that bears an unfixed toner image is heated for fixing processing while being pinched and conveyed at the nip portion N.

Exemplary Embodiment 1

Figure 2:
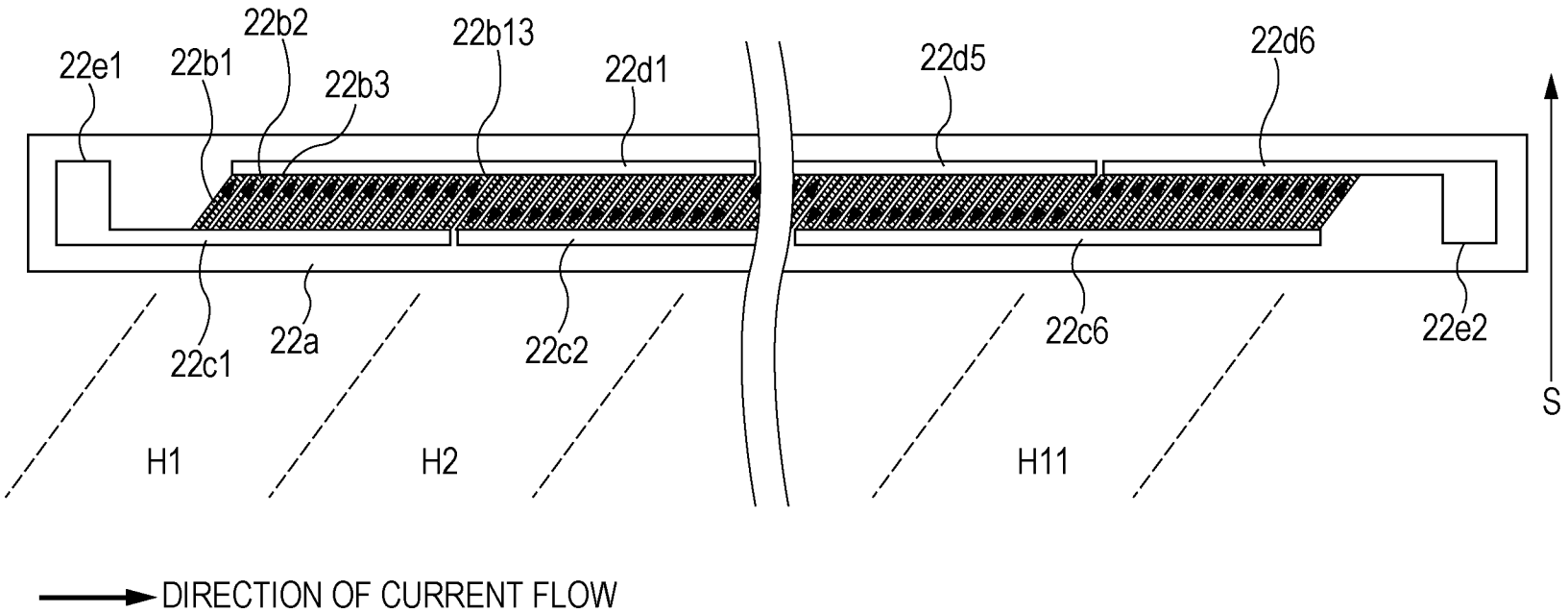
FIG. 2 is a plan view of a heater. (Exemplary Embodiment 1)

Next, the shape and characteristics of a heater 22 of Exemplary Embodiment 1 will be described with reference to FIG. 2 and FIGS. 3A and 3B. In the heater of the exemplary embodiment, an aluminum nitride substrate with a width of 12 mm, a length of 280 mm, and a thickness of 0.6 mm is used as a substrate 22*a*. A heat generating resistor 22*b* (22*b*1 to 22*b*13) is a heat generating resistor having an NTC characteristic containing ruthenium oxide ($RuO_2$) and silver-palladium (Ag—Pd) as main conductive components. Further, the heater 22 includes a first conductive pattern (first conductor) 22*c* (22*c*1 to 22*c*6) disposed on the substrate 22*a* along the substrate longitudinal direction, and a second conductive pattern (second conductor) 22*d* (22*d*1 to 22*d*6) disposed on the substrate 22*a* along the substrate longitudinal direction at a position different from that of the first conductive pattern 22*c* in the substrate lateral direction. The heat generating resistor 22*b* is connected between the first conductive pattern 22*c* and the second conductive pattern 22*d*. 22*e*1 and 22*e*2 denote electrodes to which connectors for supplying power are connected. S denotes the direction in which a recording material is conveyed.

Figure 3A:
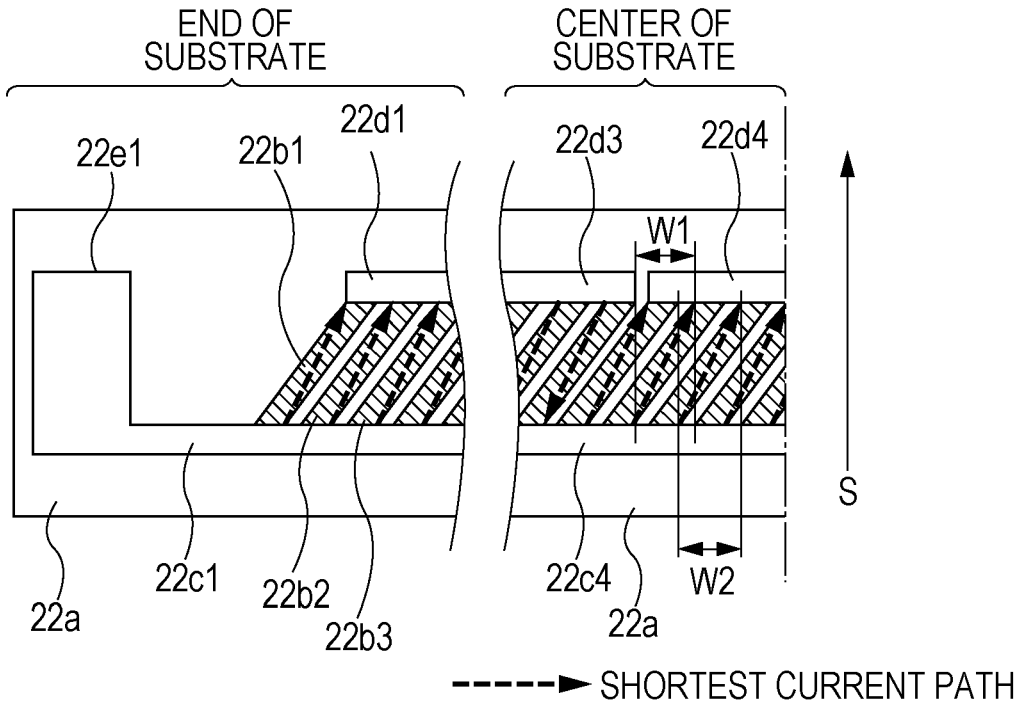
FIG. 3A is a diagram illustrating shortest current paths in the heater of Exemplary Embodiment 1.
Figure 3B:
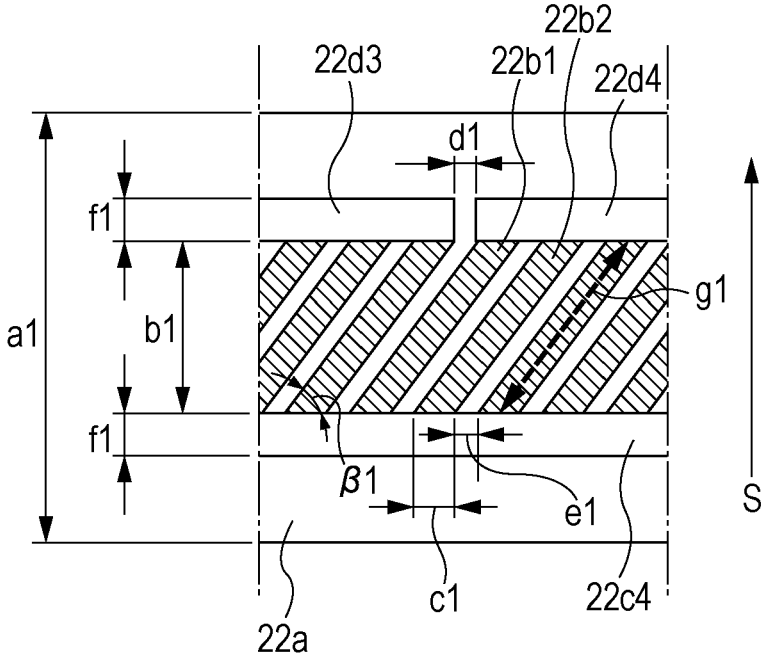
FIG. 3B is a diagram illustrating the shape of heat generating resistors in the heater of Exemplary Embodiment 1.

As illustrated in FIGS. 3A and 3B, each of the first conductive pattern 22*c* and the second conductive pattern 22*d* is divided into a plurality of portions in the substrate longitudinal direction. Further, a plurality of heat generating resistors 22*b* are connected in parallel between the first conductive pattern 22*c* and the second conductive pattern 22*d*. In the exemplary embodiment, each of the first conductive pattern 22*c* and the second conductive pattern 22*d* is divided into six portions. Between a first conductive pattern 22*c*1, which is a portion of the first conductive pattern 22*c*, and a second conductive pattern 22*d*1, which is a portion of the second conductive pattern 22*d*, 13 heat generating resistors 22*b*1 to 22*b*13 are electrically connected in parallel and form a first heat generating block H1. Further, between the second conductive pattern 22*d*1 and a first conductive pattern 22*c*2, 13 heat generating resistors 22*b*1 to 22*b*13 are also electrically connected in parallel and form a second heat generating block H2. In the heater of the exemplary embodiment, a total of 11 heat generating blocks (H1 to H11) are formed in a similar manner, and the 11 heat generating blocks (H1 to H11) are electrically connected in series. In this manner, the heater 22 is configured to have a plurality of heat generating blocks.

Next, the shape of the heat generating resistor 22*b* will be described. As illustrated in FIGS. 3A and 3B, 13 heat generating resistors 22*b*1 to 22*b*13 in each heat generating block have a parallelogram shape. Then, as illustrated in FIG. 3A, the shortest current path in each heat generating resistor is obliquely inclined with respect to the recording material conveying direction S, and, in addition, the shortest current path of each heat generating resistor overlaps the shortest current path of an adjacent heat generating resistor in the substrate longitudinal direction. In FIG. 3A, W1 denotes the region of the shortest current path of the heat generating resistor 22*b*2 in the substrate longitudinal direction, and W2 denotes the region of the shortest current path of the heat generating resistor 22*b*3 adjacent to the heat generating resistor 22*b*2 in the substrate longitudinal direction. As can be seen, the regions W1 and W2 overlap each other in the substrate longitudinal direction. With the design of the shape of the heat generating resistor 22*b* in this manner, when the heater is viewed in parallel to the recording material conveying direction S, the shortest current paths are located without spaces therebetween across the longitudinal direction of the heater. Therefore, when the recording material passes through the fixing nip portion N, an arbitrary point on the recording material always passes through a region where a current flows and heat is generated. Thus, a phenomenon in which a portion of a toner image on the recording material is insufficiently heated can be suppressed.

Next, the shape of the heat generating resistors in a case where the shortest current paths are located without spaces therebetween across the longitudinal direction of the heater when the heater is viewed in parallel to the recording material conveying direction S will be described in detail. The range within which the shortest current paths are located without spaces therebetween in the heater longitudinal direction may be set so as to be equal to the width of a typical recording material that is set as a maximum size available in an image heating apparatus or an image forming apparatus.

In a plan view of a portion of the heater illustrated in FIG. 3B, it is assumed that the length of the long sides and the length of the short sides of the parallelogram heat generating resistors 22*b* are represented by g1 and c1, respectively, the interval between adjacent heat generating resistors 22*b* in one heat generating block is represented by e1, and the angle of inclination of the heat generating resistors 22*b* is represented by β1. In this case, if the shape of the heat generating resistors 22*b* and the interval e1 are set to satisfy the relationship given in (Expression 1), a relationship in which the shortest current path of each heat generating resistor overlaps the shortest current path of an adjacent heat generating resistor in the substrate longitudinal direction can be established.

$$g1\times\cos(\beta 1)\geq c1+e1 \quad \text{(Expression 1)}$$

Further, the relationship between two heat generating resistors that define the boundary between adjacent two heat generating blocks (for example, the heat generating resistor 22*b*13 in the heat generating block H1 and the heat generating resistor 22*b*1 in the heat generating block H2) may also be set so as to satisfy (Expression 2).

$$g1\times\cos(\beta 1)\geq c1+d1 \quad \text{(Expression 2)}$$

In the heater of the exemplary embodiment, e1=d1 is set. The dimensions of the respective sections in the heater of the exemplary embodiment are as follows. The heater substrate has a width a1 of 12 mm in the lateral direction, the heat generating resistors 22*b* have a width b1 of 5 mm in the substrate lateral direction, and the heat generating resistors 22*b* have a long side g1 of 6.28 mm and a short side of 1.4 mm. The angle of inclination β1 is about 52.8°, the distance d1 between adjacent conductive patterns 22*d* (the distance between adjacent conductive patterns 22*c* is also d1) is 0.5 mm, the distance e1 between adjacent heat generating resistors in one heat generating block is 0.5 mm, and the conductive patterns 22*c* and 22*d* have a width f1 of 1.5 mm in the substrate lateral direction. A region where the heat generating resistors 22*b* are provided has a total width of 237 mm in the heater longitudinal direction. If the above values are applied to (Expression 1), g1×cos(β1)≈3.8 and c1+e1=1.9 are obtained, and therefore (Expression 1) holds true. Further, since c1+d1=1.9, (Expression 2) also holds true.

In the exemplary embodiment, the shapes of the conductive patterns and the heat generating resistors are set so that the heat generating resistors 22*b* have a temperature coefficient of resistance (TCR) of −455 ppm/° C., that is, use a paste material with NTC, and so that the heater can have a total resistance value of 20Ω. TCR, as described herein, is a numerical value ranging from 25° C. to 125° C., which is generally used as the TCR value on the high-temperature side.

As described above, heat generating resistors in one heat generating block are shaped to be elongated in the substrate lateral direction instead of being shaped to increase the width in the substrate longitudinal direction, and are connected in parallel. Therefore, the shortest current paths can be inclined with respect to the lateral direction S. In addition to this configuration, the heat generating resistors are arranged so that the shortest current path of each heat generating resistor can overlap the shortest current path of an adjacent heat generating resistor in the substrate longitudinal direction. Therefore, variations in the heat generation distribution of the heater can be kept small in the substrate longitudinal direction.

Exemplary Embodiment 2

Figure 4:
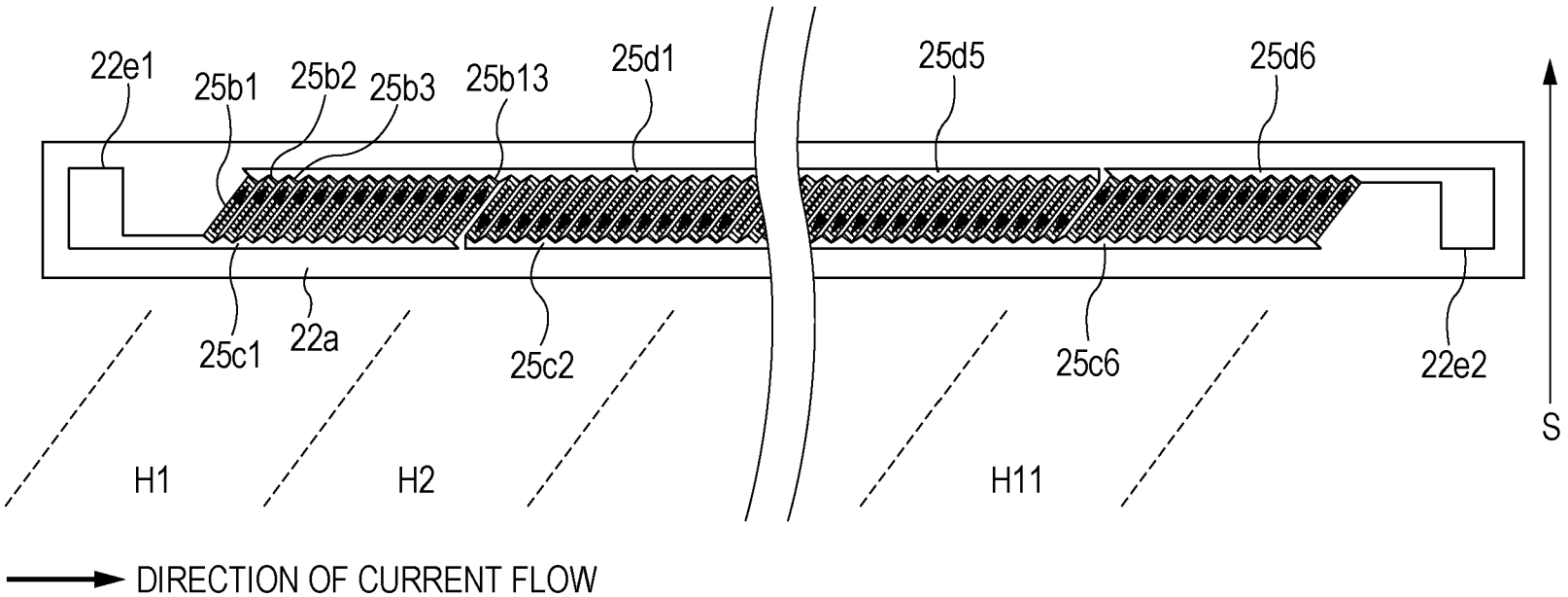
FIG. 4 is a plan view of a heater. (Exemplary Embodiment 2)
Figure 5A:
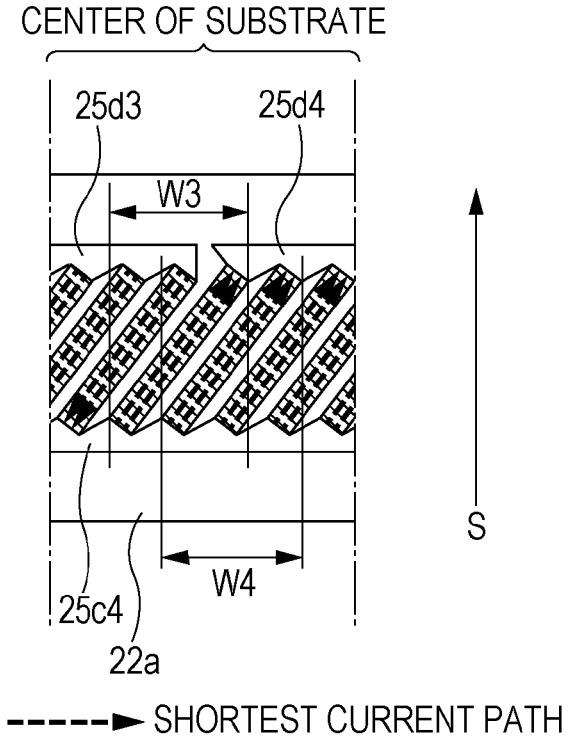
FIG. 5A is a diagram illustrating shortest current paths in the heater of Exemplary Embodiment 2.

A heater of Exemplary Embodiment 2 will be described using FIGS. 4 to 6. As illustrated in FIG. 4, in a heater 22 of Exemplary Embodiment 2, a heat generating resistor 25*b* has a rectangular shape instead of a parallelogram shape as illustrated in Exemplary Embodiment 1, and conductive patterns 25*c* and 25*d* also have different shapes from those in Exemplary Embodiment 1. Other than the heat generating resistor 25*b* and the conductive patterns 25*c* and 25*d*, a substrate 22*a* and feeder electrodes 22*e*1 and 22*e*2 are formed of materials and shapes similar to those in Exemplary Embodiment 1. A region where the heat generating resistor 25*b* is provided has a total width of 237 mm in the longitudinal direction of the heater. Further, the heat generating resistor 25*b* is formed by adjusting the materials and the mixing ratio so that the total resistance value can be equal to that in Exemplary Embodiment 1, that is, 20Ω, and the TCR at 25° C. to 125° C. is −430 ppm/° C.

As in the heater of Exemplary Embodiment 1, in the heater of Exemplary Embodiment 2, the heat generating resistor 25*b* is divided into 11 heat generating blocks. Further, one heat generating block is divided into 13 heat generating resistors so that the shortest current path of one heat generating resistor can be obliquely inclined with respect to the recording material conveying direction, which is the same as that in Exemplary Embodiment 1. The 13 rectangular heat generating resistor segments 25*b* (25*b*1 to 25*b*13) are electrically connected in parallel and form a single heat generating block. Further, the number of groups of 13 heat generating resistors 25*b*, that is, heat generating blocks, is 11, and the 11 heat generating blocks (H1 to H11) are electrically connected in series.

In the exemplary embodiment, since the heat generating resistors are formed into a rectangular shape, the shortest current path located in each of the heat generating resistors 25*b* is not a single line but forms an entire surface of the heat generating resistor. Also in the exemplary embodiment, as in Exemplary Embodiment 1, the shortest current paths are formed obliquely with respect to the recording material conveying direction S. FIG. 5A illustrates the direction of the shortest current paths. Since the shortest current path in one heat generating resistor is wider than that in the heater of Exemplary Embodiment 1, two arrows are drawn for an individual heat generating resistor. Further, as illustrated in FIG. 6, the conductive patterns 25*c* and 25*d* have Δ (delta) shaped regions in order to form each heat generating resistor into a rectangular shape. The Δ shaped regions of the conductive patterns may have any other shape as long as the heat generating resistors can be formed into a rectangular shape, and the shape is not limited to Δ.

As in the exemplary embodiment, the shortest current path located in each of the heat generating resistors 25*b* is formed into a flat surface instead of a single line as in Exemplary Embodiment 1, thus providing a merit of higher heat transfer efficiency to the film 23 and the recording material than that in the configuration of Exemplary Embodiment 1. Also in the exemplary embodiment, since the shortest current path of each heat generating resistor overlaps the shortest current path of an adjacent heat generating resistor in the substrate longitudinal direction, variations in the heat generation distribution of the heater can be kept small. In FIG. 5A, W3 denotes the region of the shortest current path of the heat generating resistor 25*b*1 in the substrate longitudinal direction, and W4 denotes the region of the shortest current path of the heat generating resistor 25*b*2 adjacent to the heat generating resistor 25*b*1 in the substrate longitudinal direction. As can be seen, the regions W3 and W4 overlap each other in the substrate longitudinal direction. With the design of the shape of the heat generating resistor 25*b* in this manner, when the heater is viewed in parallel to the recording material conveying direction S, the shortest current paths are located without spaces therebetween across the longitudinal direction of the heater. Therefore, when the recording material passes through the fixing nip portion N, an arbitrary point on the recording material always passes through a region where a current flows and heat is generated. Thus, a phenomenon in which a portion of a toner image on the recording material is insufficiently heated can be suppressed.

In order to achieve a relationship in which the shortest current path of each heat generating resistor overlaps the shortest current path of an adjacent heat generating resistor in the substrate longitudinal direction, (Expression 3) may be satisfied.

$$g2\times\cos(\beta 2)-h2\times\cos(\beta 2)/\tan(\beta 2)\geq e2 \quad \text{(Expression 3)}$$

Figure 5B:
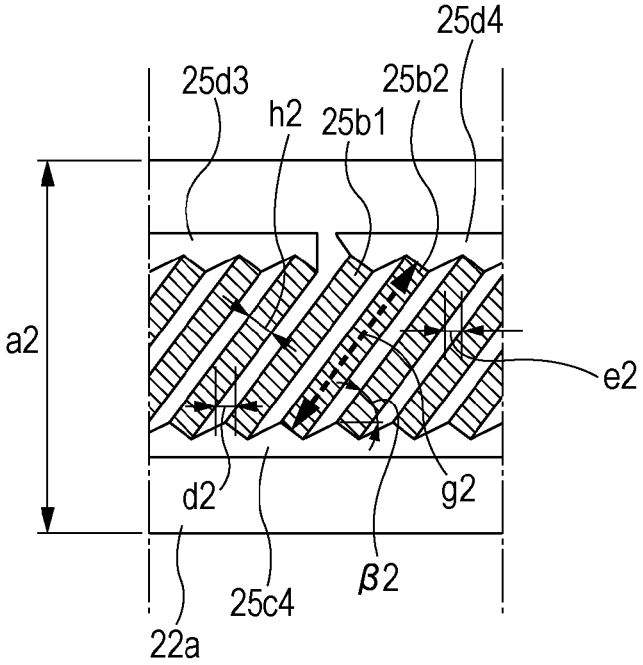
FIG. 5B is a diagram illustrating the shape of heat generating resistors in the heater of Exemplary Embodiment 2.
Figure 6:
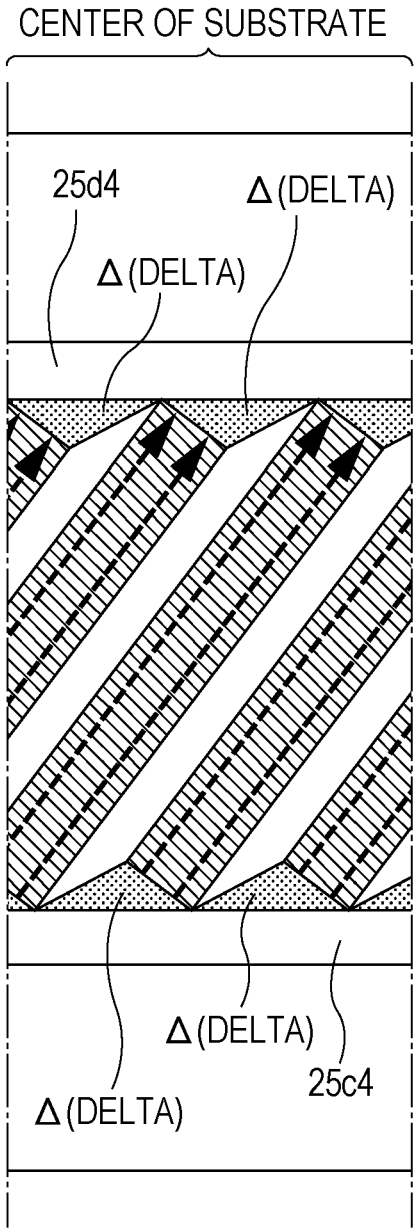
FIG. 6 is an enlarged view of the center of a substrate of the heater of Exemplary Embodiment 2, describing the shape of conductive patterns in the heater.

Here, as illustrated in FIG. 5B, it is assumed that the length of the long sides and the length of the short sides of the rectangular heat generating resistors 25*b* are represented by g2 and h2, respectively, the interval between adjacent heat generating resistors 25*b* is represented by e2, and the angle of inclination of the heat generating resistors 25*b* is represented by β2. Further, the relationship between two heat generating resistors that define the boundary between adjacent two heat generating blocks (for example, the heat generating resistor 25*b*13 in the heat generating block H1 and the heat generating resistor 25*b*1 in the heat generating block H2) may also be set so as to satisfy (Expression 4) in which e2 in (Expression 3) is replaced by d2.

$$g2\times\cos(\beta 2)-h2\times\cos(\beta 2)/\tan(\beta 2)\geq d2 \quad \text{(Expression 4)}$$

The dimensions of the respective sections in the heater of the exemplary embodiment are as follows. The heater substrate has a width a2 of 12 mm in the lateral direction, the heat generating resistors 25*b* have a long side g2 of 7.0 mm, a short side h2 of 1.0 mm, and an angle of inclination β2 of about 52.8°, and the distances e2 and d2 between heat generating resistors are 0.5 mm. If the above numerical values are applied, $g2\times\cos(\beta 2)-h2\times\cos(\beta 2)/\tan(\beta 2)\approx 3.8$ and $e2=0.5$ are obtained, and (Expression 2) holds true. Similarly, (Expression 4) also holds true.

Exemplary Embodiment 3

Figure 7:
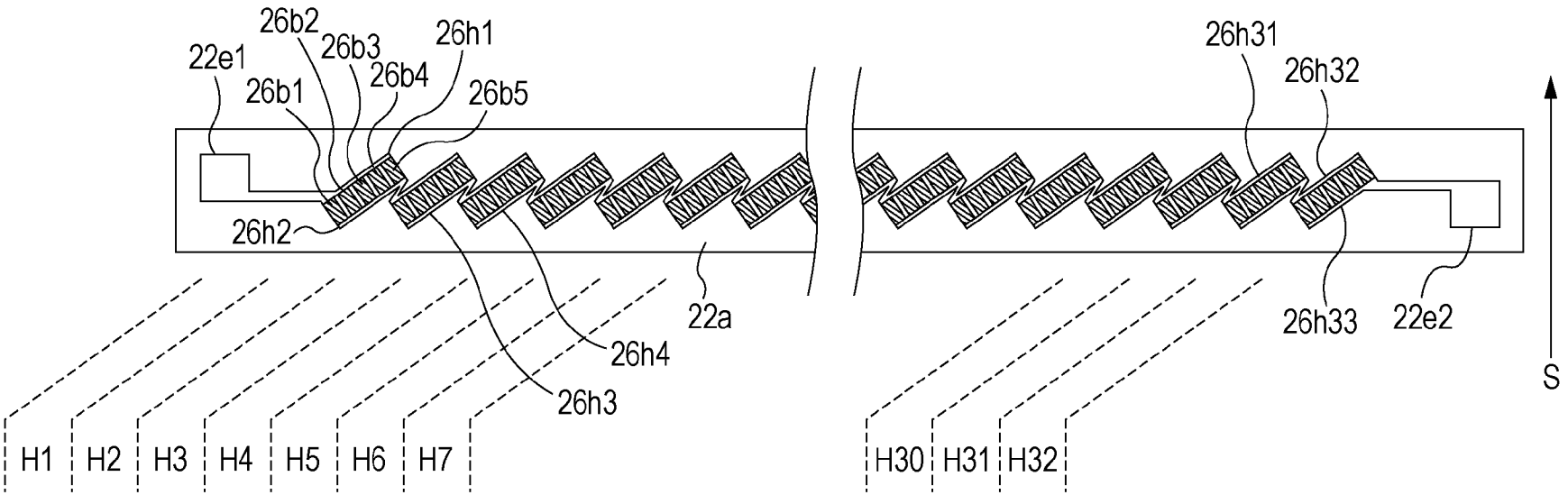
FIG. 7 is a plan view of a heater. (Exemplary Embodiment 3)

A heater of Exemplary Embodiment 3 will be described using FIG. 7 and FIGS. 8A and 8B. As illustrated in FIG. 7, in a heater 22 of Exemplary Embodiment 3, a heat generating resistor 26*b* is divided into 32 heat generating blocks (H1 to H32), and each heat generating block is divided into five heat generating resistors (26*b*1 to 26*b*5) so that the shortest current paths can be oblique to the recording material conveying direction. The heat generating resistors 26*b* each of which is divided into five rectangular segments are electrically connected in parallel. Further, the 32 groups of heat generating resistors 26*b*, that is, heat generating blocks H1 to H32, are electrically connected in series. As illustrated in FIG. 7, in the exemplary embodiment, conductive patterns 26*h*1 to 26*h*33, which are not in parallel to but are inclined with respect to the substrate longitudinal direction, are provided along the substrate longitudinal direction. In the heat generating block H1, the conductive pattern 26*h*1 corresponds to a first conductor, and the conductive pattern 26*h*2 corresponds to a second conductor. Further, in the heat generating block H2, the conductive pattern 26*h*2 corresponds to a first conductor, and the conductive pattern 26*h*3 corresponds to a second conductor. A region where the heat generating resistors 26*b* are formed has a total width of 224.2 mm in the heater longitudinal direction. The heat generating resistors 26*b* are formed by adjusting the materials and the mixing ratio so that the total resistance value can be equal to that in Exemplary Embodiments 1 and 2, that is, 20Ω, and the TCR at 25° C. to 125° C. is −435 ppm/° C.

Also in the exemplary embodiment, since the heat generating resistors are formed into a rectangular shape, the shortest current path located in each of the heat generating resistors 26*b* is not a single line but forms an entire surface of the heat generating resistor. In each heat generating block, a plurality of heat generating resistors are connected in parallel. Thus, also in the embodiment, as in Exemplary Embodiments 1 and 2, the shortest current paths are formed obliquely with respect to the recording material conveying direction S (FIG. 8A). Further, heat generating resistors are formed so that the shortest current path of each heat generating resistor can overlap the shortest current path of an adjacent heat generating resistor in the substrate longitudinal direction so that variations in the heat generation distribution in the heater longitudinal direction can be kept small. As illustrated in FIG. 8B, the dimensions of the respective sections in the heater of the exemplary embodiment are as follows. The heater substrate has a width a3 of 12 mm in the lateral direction, the heat generating resistors 26*b* have a short side g3 of 1.3 mm and a long side h3 of 2.5 mm, and the interval e3 between adjacent heat generating blocks is 2.6 mm, the interval e31 between adjacent heat generating resistors 26*b* is 0.5 mm, and the angle of inclination β3 is 35°.

Figure 8A:
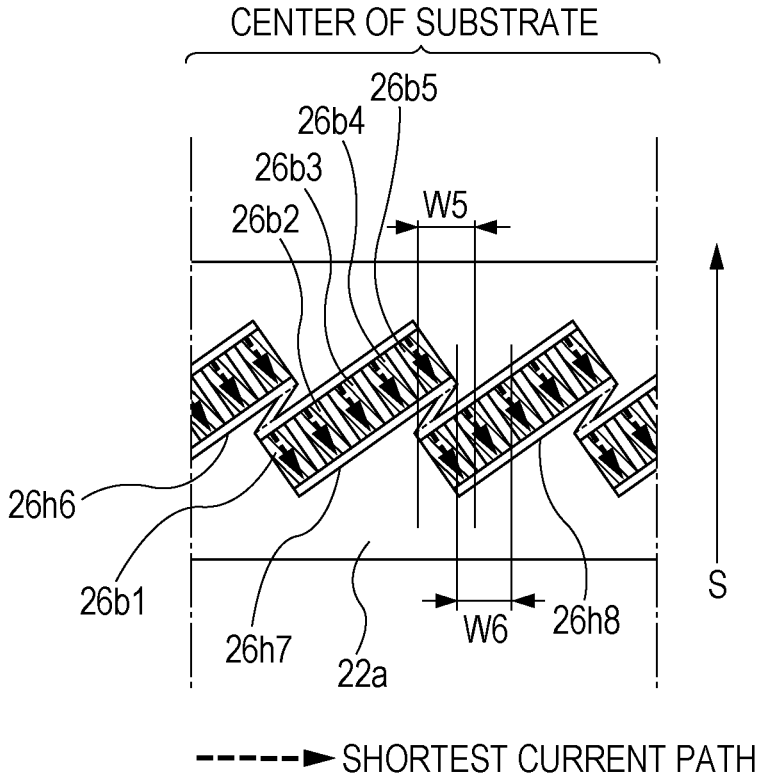
FIG. 8A is a diagram illustrating shortest current paths in the heater of Exemplary Embodiment 3.
Figure 8B:
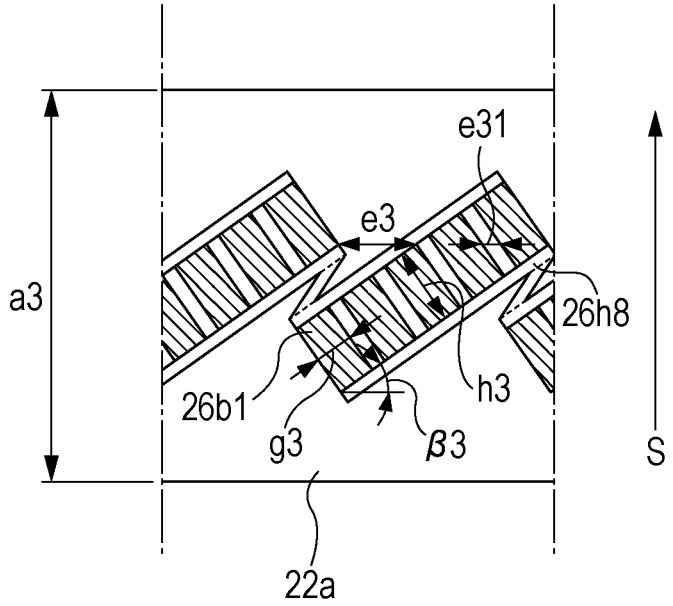
FIG. 8B is a diagram illustrating the shape of heat generating resistors in the heater of Exemplary Embodiment 3.

Further, a visual representation of the shortest current paths that overlap each other is illustrated in FIG. 8A. W5 denotes the region of the shortest current path of the heat generating resistor 26*b*1 in the substrate longitudinal direction, and, similarly, W6 denotes the region of the heat generating resistor 26*b*2 adjacent to the heat generating resistor 26*b*1 in the substrate longitudinal direction. As is apparent from FIG. 8A, since the shortest current paths of adjacent heat generating resistors overlap each other in the substrate longitudinal direction, when the heater is viewed in parallel to the recording material conveying direction S, shortest current paths are configured to be always located across the longitudinal direction of the heater. Further, the relationship between two heat generating resistors that define the boundary between adjacent two heat generating blocks (for example, the heat generating resistor 26*b*5 in the heat generating block H1 and the heat generating resistor 26*b*1 in the heat generating block H2) is also a relationship in which the shortest current paths thereof overlap each other.

Exemplary Embodiment 4

Figure 9:
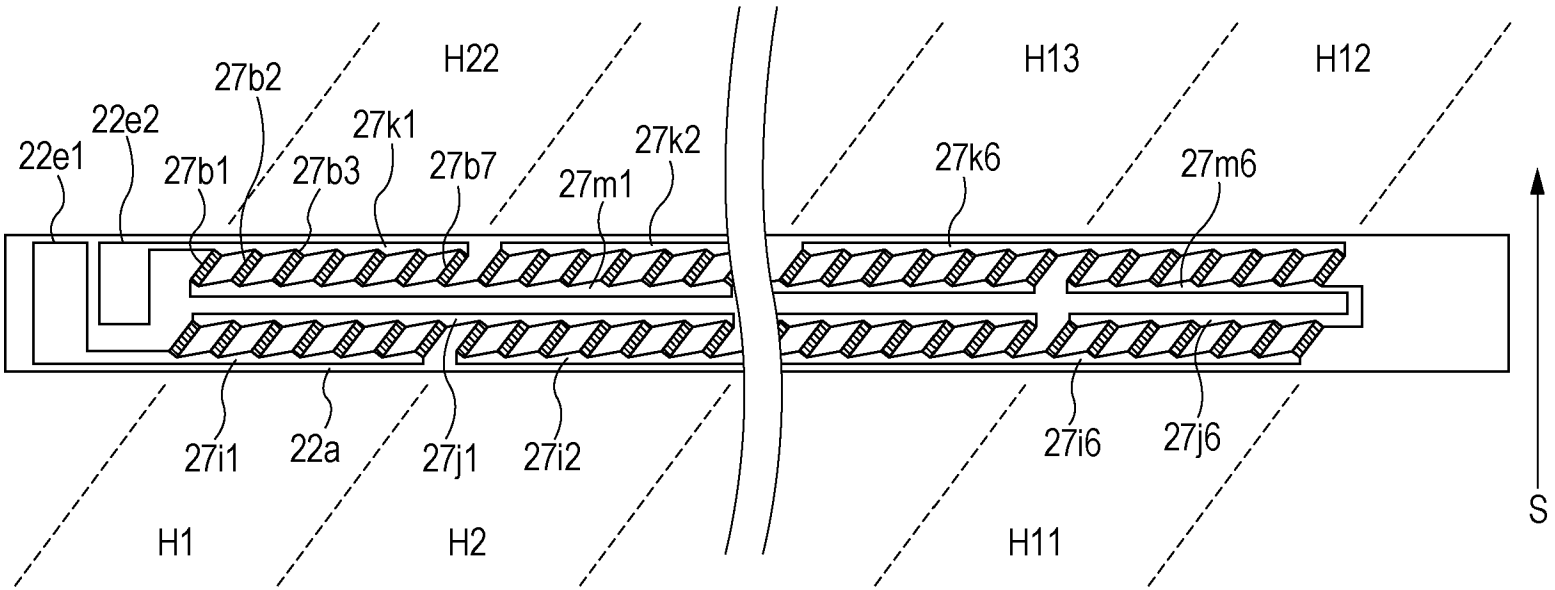
FIG. 9 is a plan view of a heater. (Exemplary Embodiment 4)
Figure 10A:
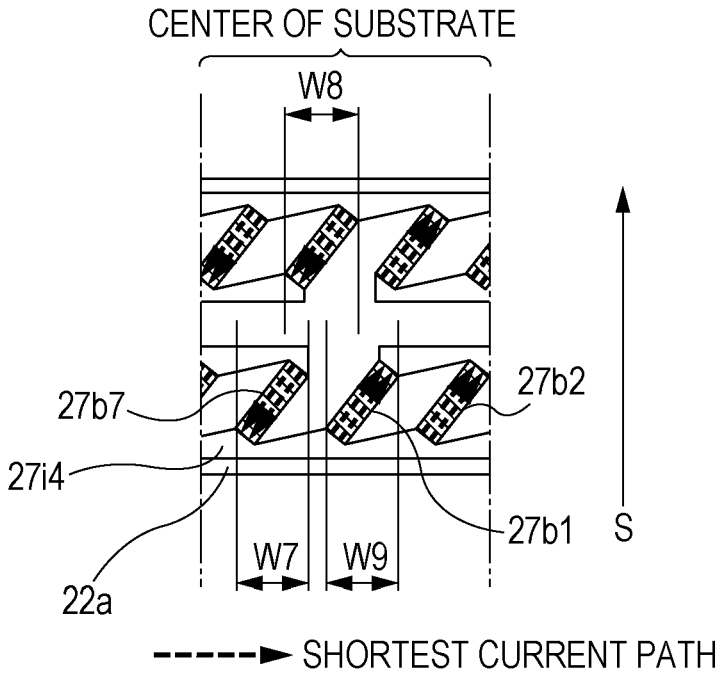
FIG. 10A is a diagram illustrating shortest current paths in a heater of Exemplary Embodiment 4.

A heater of Exemplary Embodiment 4 will be described using FIG. 9 and FIGS. 10A and 10B. As illustrated in FIG. 9, in a heater 22 of Exemplary Embodiment 4, a heat generating resistor 27*b* is also formed into a rectangular shape which is similar to the shape illustrated in Exemplary Embodiment 2, of which the length of the long sides is half that of the heat generating resistors 25*b* of Exemplary Embodiment 2. Further, the current supplied from a feeder electrode 22*e*1 is configured to reach the heater end opposite to the end where the electrode 22*e*1 is provided in the heater longitudinal direction and then return and reach a feeder electrode 22*e*2, that is, a return heat generation pattern in which a plurality of rows of heat generating resistors are provided is obtained. For this reason, four rows (27*i*, 27*j*, 27*m*, 27*k*) of conductive patterns are provided in the substrate lateral direction. In the heaters of Exemplary Embodiments 1 to 3, one of two feeder electrodes is disposed at each end in the heater longitudinal direction. In contrast, in the configuration of the exemplary embodiment, both the two feeder electrodes 22*e*1 and 22*e*2 are located at one end of the heater in the longitudinal direction thereof, thus providing a merit that only one connector to be connected to the electrodes is required.

A substrate 22*a* is formed of a material and shape similar to those in Exemplary Embodiment 1. A region where the heat generating resistor 27*b* divided into a plurality of portions is formed has a total width of 237 mm in the heater longitudinal direction. Further, the heat generating resistor 27*b* is formed by adjusting the materials and the mixing ratio so that the total resistance value can be equal to that in Exemplary Embodiment 1, that is, 20Ω, and the TCR at 25° C. to 125° C. is set to −230 ppm/° C.

The heat generating resistor 27*b* is divided into 22 heat generating blocks (11 heat generating blocks×one return) in the longitudinal direction of the heater 22, and one heat generating block includes 7 heat generating resistor segments (27*b*1 to 27*b*7) so that the shortest current paths can be oblique to the recording material conveying direction. The 7 rectangular heat generating resistor segments 27*b* are electrically connected in parallel, and the 22 heat generating blocks H1 to H22 are electrically connected in series. Also in the exemplary embodiment, since each heat generating resistor is formed into a rectangular shape, the shortest current path located in each of the heat generating resistors 27*b* forms an entire surface of the heat generating resistor.

Meanwhile, in the exemplary embodiment, as described above, a plurality of rows (in the exemplary embodiment, two rows) of heat generating blocks are provided at different positions in the lateral direction of the substrate. Then, the shortest current path of each heat generating resistor in one row of heat generating block in the lateral direction overlaps the shortest current path of each heat generating resistor in another row of heat generating block in the longitudinal direction. Specifically, as illustrated in FIG. 10A, the shortest current paths of adjacent two heat generating resistors in one heat generating block (for example, the heat generating resistors 27*b*1 and 27*b*2 in the heat generating block H1) do not overlap each other in the substrate longitudinal direction. However, the shortest current paths of adjacent two heat generating resistors in different rows of heat generating blocks in the longitudinal direction (for example, the heat generating resistor 27*b*7 (region W7) in the heat generating block H6 and the heat generating resistor 27*b*7 (region W8) in the heat generating block H17) overlap each other in the substrate longitudinal direction. Even with the above shape, variations in the heat generation distribution in the longitudinal direction of the heater can also be kept small.

Figure 10B:
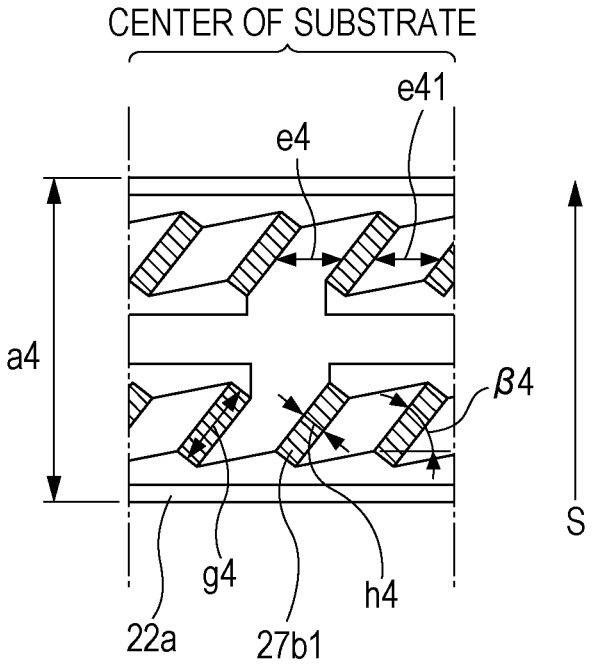
FIG. 10B is a diagram illustrating the shape of heat generating resistors in the heater of Exemplary Embodiment 4.

As illustrated in FIG. 10B, the dimensions of the respective sections in the heater of the exemplary embodiment are as follows. The heater substrate 22*a* has a width a4 of 12 mm in the substrate lateral direction, the heat generating resistors 27*b* have a long side g4 of 3.5 mm, a short side h4 of 1.0 mm, and an angle of inclination β4 of about 52.8°, and the distance e41 between the 7 heat generating resistor segments is 2.3 mm. The distance e4 between the heat generating blocks is also 2.3 mm.

Exemplary Embodiment 5

Figure 11:
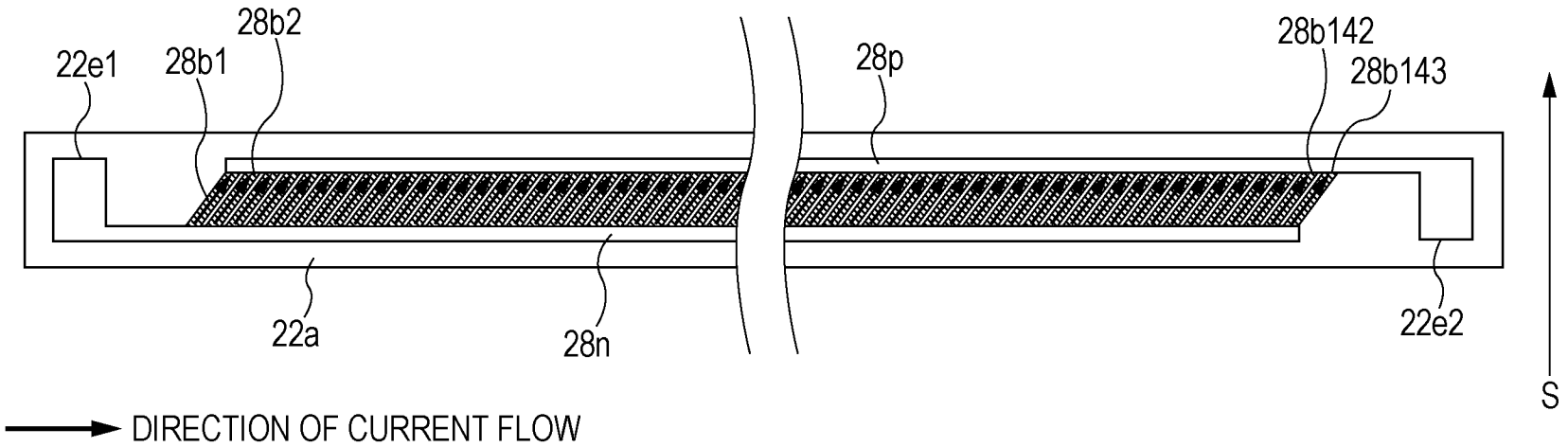
FIG. 11 is a plan view of a heater. (Exemplary Embodiment 5)
Figure 12:
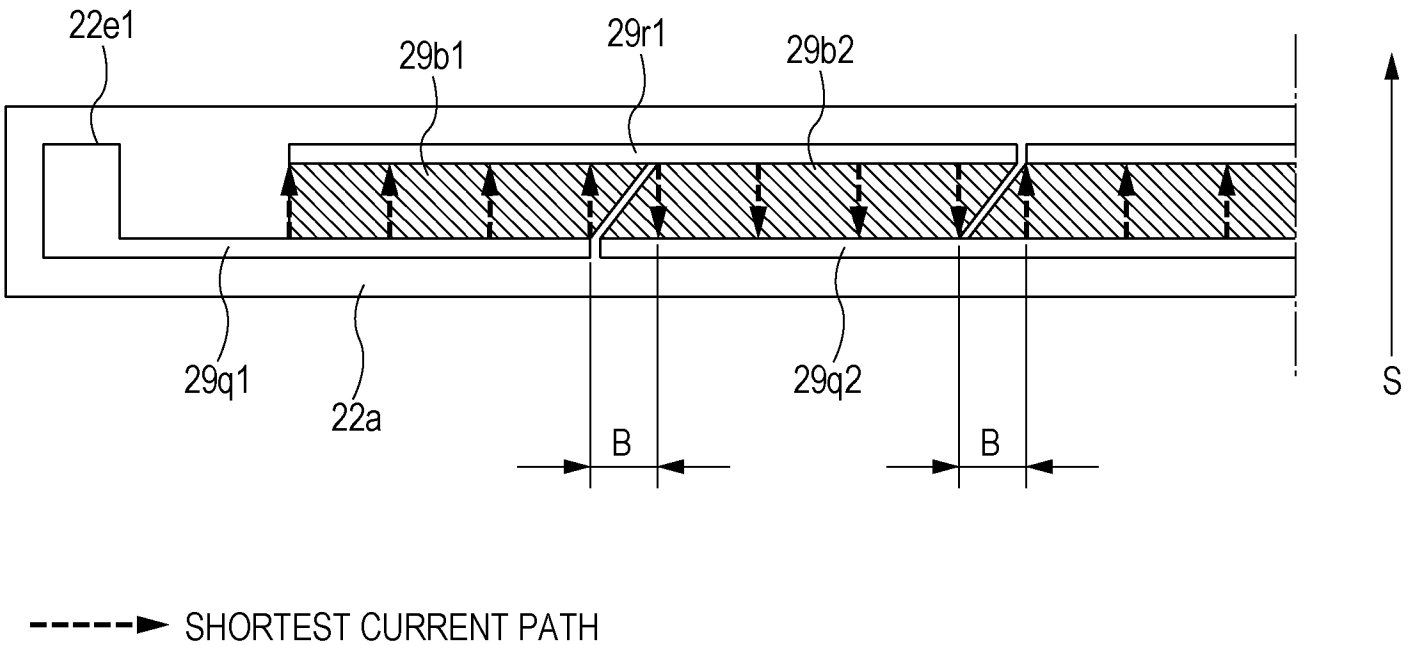
FIG. 12 is a plan view of a heater. (Background Art)

A heater of Exemplary Embodiment 5 will be described using FIG. 11. The shape of the heater is an exemplary modification of the heater of Exemplary Embodiment 1, and as illustrated in FIG. 11, two conductive patterns 28*n* and 28*p* are not divided in the substrate longitudinal direction. This type is therefore the type in which only one heat generating block is located. The number of heat generating resistors connected in parallel between the conductive patterns 28*n* and 28*p* is 143 (28*b*1 to 28*b*143). The shortest current paths of adjacent heat generating resistors overlap each other in the substrate longitudinal direction, which is similar to Exemplary Embodiment 1. However, heat generating resistors exhibit PTC instead of NTC. Materials with PTC have very low volume resistivity, and it is effective to provide the configuration in which, as in Exemplary Embodiment 1, a heat generating block is divided into a plurality of portions. However, the shape in the exemplary embodiment may also be used if a material with PTC having a relatively high volume resistivity can be used as a heat generating resistor.

In Exemplary Embodiments 1 to 4 described above, heat generating resistors that exhibit NTC have been illustrated by way of example. However, even in the case of heat generating resistors that exhibit PTC, the heat generating resistors are shaped so as to have the configuration in which, as in Exemplary Embodiments 1 to 4, the shortest current paths overlap each other. Therefore, variations in the heat generation distribution in the substrate longitudinal direction can be kept small.

According to the present invention, it is possible to suppress a variation in the heat generation distribution in the longitudinal direction of a heater.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/065903, filed Sep. 11, 2009, which is hereby incorporated by reference herein in its entirety.

INDUSTRIAL APPLICABILITY

The present invention can be applied not only to a fixing apparatus that fixes an unfixed toner image onto a recording material but also to an image heating apparatus that improves the glossiness of an image by heating again a toner image that has already been fixed onto a recording material, such as a glossiness adding apparatus.

REFERENCE SIGNS LIST

22 heater
22*a* heater substrate
22*b* heat generating resistor
22*c*, 22*d* conductive pattern
22*e*1, 22*e*2 electrode
23 film
24 pressure roller
P recording material
N fixing nip portion

What is claimed is:

1. A heater comprising:
a substrate;
a first conductor provided on the substrate along a longitudinal direction of the substrate;
a second conductor provided on the substrate along the longitudinal direction of the substrate at a position different from a position of the first conductor in a lateral direction of the substrate; and
a plurality of heat generating resistors connected between the first conductor and the second conductor,
wherein the plurality of heat generating resistors are connected in parallel between the first conductor and the second conductor, and a shortest current path of each resistor overlaps a shortest current path of an adjacent heat generating resistor in the longitudinal direction of the substrate.

2. The heater according to claim 1, further comprising a plurality of heat generating blocks each having the plurality of heat generating resistors connected in parallel, wherein the blocks are connected in series.

3. The heater according to claim 1, wherein the heat generating resistors are formed into a rectangular shape, and each of the first conductor and the second conductor is provided with a triangular shaped region so that the heat generating resistors are formed into the rectangular shape.

4. An image heating apparatus comprising:
an endless belt;
a heater that comes in contact with an inner surface of the endless belt; and
a nip forming member that forms a nip portion together with the heater with the endless belt therebetween, the apparatus being adapted to heat a recording material that bears an image while pinching and conveying the recording material at the nip portion,
wherein the heater is the heater according to claim 1.

5. The apparatus according to claim 4, wherein the heater further comprises a plurality of blocks each having the plurality of heat generating resistors connected in parallel, wherein the blocks are connected in series.

6. The apparatus according to claim 4, wherein the heat generating resistors are formed into a rectangular shape, and each of the first conductor and the second conductor is provided with a triangular shaped region so that the heat generating resistors are formed into the rectangular shape.

7. A heater comprising:
a substrate;
a first conductor provided on the substrate along a longitudinal direction of the substrate;
a second conductor provided on the substrate along the longitudinal direction of the substrate at a position different from a position of the first conductor in a lateral direction of the substrate; and
a plurality of heat generating resistors connected between the first conductor and the second conductor,
wherein a plurality of rows of blocks each having the plurality of heat generating resistors connected in parallel between the first conductor and the second conductor are provided at different positions in the lateral direction of the substrate, and a shortest current path of each heat generating resistor in one of the rows of blocks in the lateral direction overlaps a shortest current path of each heat generating resistor in another row of blocks in the longitudinal direction.

8. The heater according to claim 7, wherein the heater is configured such that one row includes a plurality of the blocks and the blocks in one row are connected in series.

9. The heater according to claim 7, wherein the heat generating resistors are formed into a rectangular shape, and each of the first conductor and the second conductor is provided with a triangular shaped region so that the resistors are formed into the rectangular shape.

10. An image heating apparatus comprising:
an endless belt;
a heater that comes in contact with an inner surface of the endless belt; and
a nip forming member that forms a nip portion together with the heater with the endless belt therebetween, the apparatus being adapted to heat a recording material that bears an image while pinching and conveying the recording material at the nip portion,
wherein the heater is the heater according to claim 7.

11. The apparatus according to claim 10, wherein the heater is configured such that one row includes a plurality of the blocks and the blocks in one row are connected in series.

12. The apparatus according to claim 10, wherein the heat generating resistors are formed into a rectangular shape, and each of the first conductor and the second conductor is provided with a triangular shaped region so that the heat generating resistors are formed into the rectangular shape.

* * * * *